US009573669B1

(12) United States Patent
Araki

(10) Patent No.: US 9,573,669 B1
(45) Date of Patent: Feb. 21, 2017

(54) STAND-UP TYPE PERSONAL WATERCRAFT

(71) Applicant: Kawasaki Jukogyo Kabushiki Kaisha, Kobe-shi, Hyogo (JP)

(72) Inventor: Toshio Araki, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 14/983,911

(22) Filed: Dec. 30, 2015

(51) Int. Cl.
*B63H 21/32* (2006.01)
*B63B 35/73* (2006.01)
*B63B 3/48* (2006.01)

(52) U.S. Cl.
CPC ..... *B63H 21/32* (2013.01); *B63B 3/48* (2013.01); *B63B 35/731* (2013.01)

(58) Field of Classification Search
CPC ..... B63B 35/73; B63B 3/48; B63H 21/32
See application file for complete search history.

(56) References Cited

U.S. PATENT DOCUMENTS 5,234,364 A * 8/1993 Ito ..... B63H 21/32 114/55.5
5,813,888 A * 9/1998 Ozawa ..... F01P 3/205 440/38
6,145,458 A * 11/2000 Hattori ..... B63B 35/731 114/55.57
6,261,140 B1 * 7/2001 Yoshida ..... B63H 21/32 440/88 R
7,326,093 B2 2/2008 Tsumiyama et al.
2001/0050038 A1 * 12/2001 Gohara ..... B63H 21/32 114/55.5
2002/0160672 A1 * 10/2002 Hattori ..... B63H 21/24 440/88 A
2006/0063445 A1 * 3/2006 Yokoya ..... B63C 7/003 440/89 R
2006/0286877 A1 * 12/2006 Kamio ..... B63B 35/731 440/89 J

* cited by examiner

*Primary Examiner* — Stephen Avila
(74) *Attorney, Agent, or Firm* — Alleman Hall McCoy Russell & Tuttle LLP

(57) ABSTRACT

A stand-up type personal watercraft comprises a body including a deck and a hull; a standing deck provided at the deck and located rearward relative to an engine room; a pair of deck fins located on right and left sides of the standing deck, respectively, and protruding upward; a muffler through which an exhaust gas from the engine flows; a first exhaust pipe which guides the exhaust gas from the engine to the muffler; and a second exhaust pipe which guides the exhaust gas outside from the muffler. The muffler is placed below the deck fin located on one side, and accommodated in the hull. The first exhaust pipe extends rearward on the one side from the engine and is connected to the muffler. A portion of the second exhaust pipe extends in a forward and rearward direction inside the deck fin located on the other side.

4 Claims, 3 Drawing Sheets

STAND-UP TYPE PERSONAL WATERCRAFT

BACKGROUND OF THE INVENTION

Field of the Invention

The present invention relates to a stand-up type personal watercraft including an engine.

Description of Related Art

U.S. Pat. No. 7,326,093 B2 teaches an exhaust system which may be incorporated into both of a straddle-type personal watercraft and a stand-up type personal watercraft. An exhaust pipe extends forward from an engine and is coupled to a water muffler placed at a bow, at the left part of a body of the watercraft. The exhaust pipe extends rearward from the water muffler at the right part of the body and is opened at a stern. An exhaust gas is released to water in the lower right portion of the stern.

The engine is accommodated in an engine room formed rearward relative to the bow. Although the downstream end of the exhaust pipe is placed at the stern, the exhaust pipe is laid out in a roundabout manner to extend forward from the engine and then to the stern. To realize such a long path length of the pipe, it is necessary to connect a number of pipe members. For this reason, an operation for connecting the pipe members or an operation for mounting the exhaust system in the body is complicated. If the water muffler is accommodated in a deck fin, it becomes necessary to increase the width of the deck fin so that the width of the deck fin becomes greater than the diameter of the water muffler. This reduces the width of a standing deck on which a rider stands. As a result, the rider cannot steer the personal watercraft easily.

SUMMARY OF THE INVENTION

An object of the present invention is to simplify the structure of an exhaust system in a stand-up type personal watercraft incorporating an engine.

According to an aspect of the present invention, a stand-up type personal watercraft comprises a body including a deck and a hull, and containing an engine room formed therein; an engine accommodated in the engine room; a standing deck which is provided at the deck, located rearward relative to the engine room, and on which a rider stands; a pair of deck fins located on a left side and a right side of the standing deck, respectively, and protruding upward; a muffler through which an exhaust gas emitted from the engine flows, and which reduces a noise of the exhaust gas flowing through the muffler; a first exhaust pipe which guides the exhaust gas emitted from the engine to the muffler; and a second exhaust pipe which guides the exhaust gas which has flowed through the muffler, to outside of the personal watercraft, wherein the muffler is placed below the deck fin located on a first side which is one of the left side and the right side, and accommodated in the hull, wherein the first exhaust pipe extends rearward on the first side from the engine and is connected to the muffler, and wherein a portion of the second exhaust pipe extends in a forward and rearward direction in an interior of the deck fin located on a second side which is the other of the right side and left side.

In accordance with this configuration, the deck fins are provided on the left side and the right side of the standing deck. The muffler is efficiently placed in a space formed below the deck fin. It is not necessary for the deck fin to have a great width to accommodate the muffler therein. Since the width of the deck fin can be reduced, the width of the standing deck can be increased.

The deck fins and the standing deck are placed rearward relative to the engine. The muffler is placed below the deck fin, and the second exhaust pipe is accommodated in the deck fin. The muffler and the second exhaust pipe are placed rearward relative to the engine. The first exhaust pipe extends rearward from the engine and is connected to the muffler. In this layout, members laid out in front of the engine can be omitted from the exhaust system. This can shorten the path length of the pipes included in the exhaust system. Thus, the structure of the exhaust system can be simplified. As a result, an operation for connecting the pipe members or an operation for mounting the exhaust system in the body can be easily performed.

DETAILED DESCRIPTION OF THE PREFERRED EMBODIMENTS

Hereinafter, the embodiment will be described with reference to the drawings. The stated directions are from the perspective of a rider riding in a personal watercraft 1.

Figure 1:
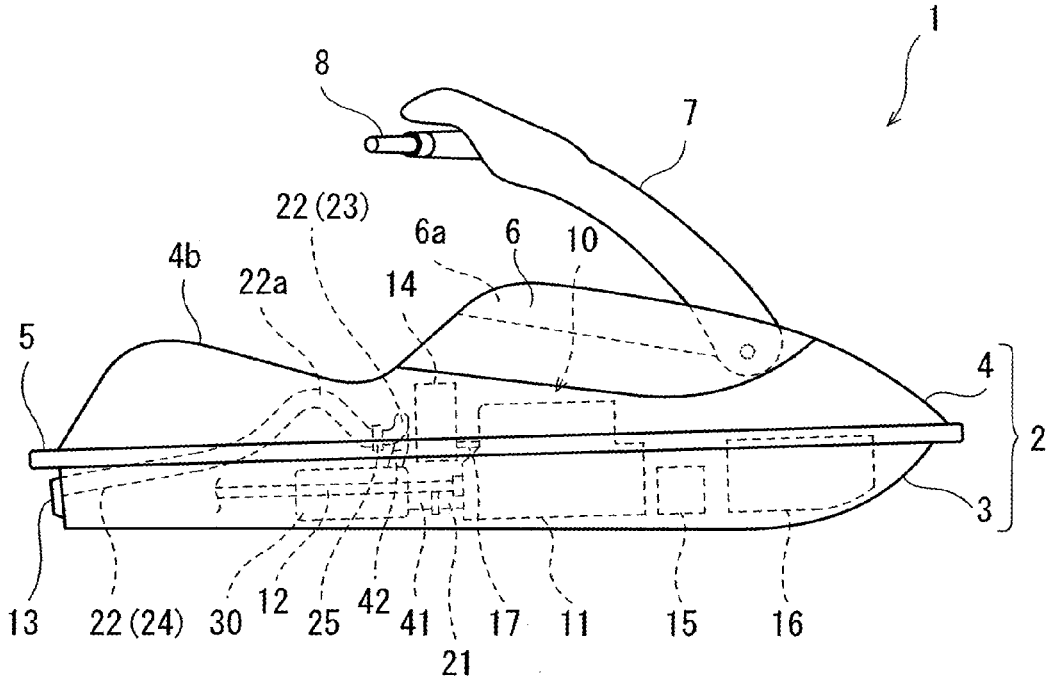
FIG. 1 is a side view of a personal watercraft according to an embodiment.
Figure 2:
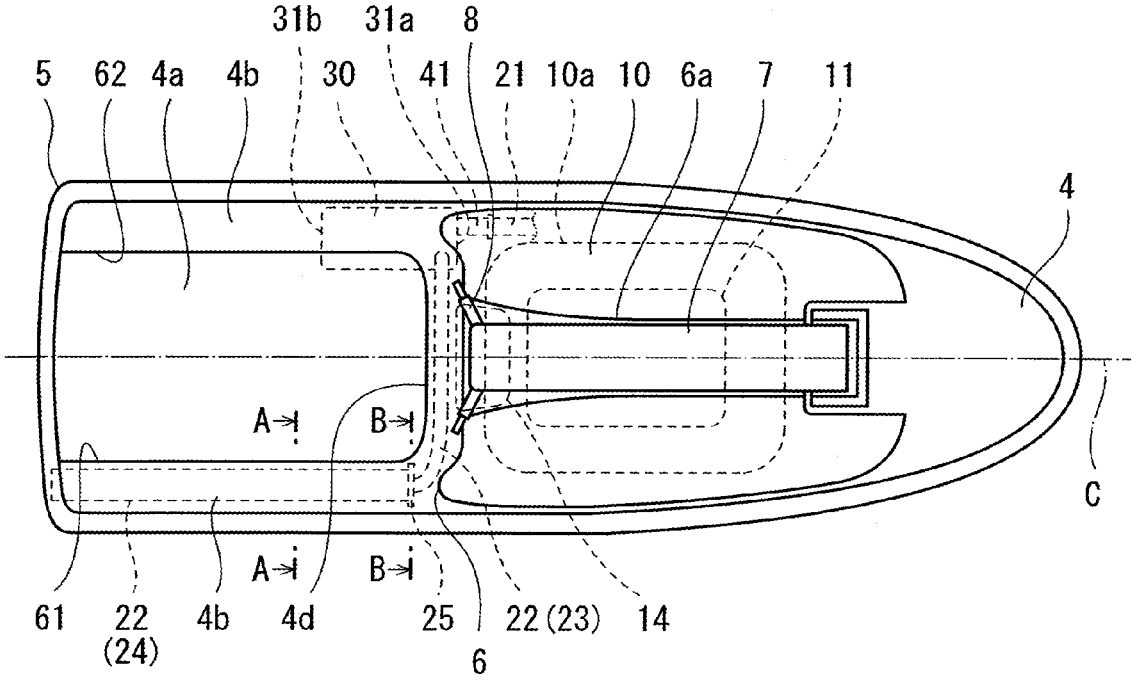
FIG. 2 is a plan view of the personal watercraft.

As shown in FIGS. 1 and 2, the personal watercraft 1 includes a body 2 including a hull 3 and a deck 4. The deck 4 covers the hull 3 from above, and is connected to the hull 3. A connection line of the hull 3 and the deck 4 is in some cases called a gunnel line. An engine room 10 is provided in the interior of the body 2, is in communication with a maintenance opening 10*a* provided in the deck 4, and is opened upward through the maintenance opening 10*a*. An engine hood 6 covers the maintenance opening 10*a* from above, and is detachably attached to the deck 4.

The personal watercraft 1 is a stand-up type personal watercraft which is steered by the rider in a standing posture. A standing deck 4*a*, and right and left deck fins 4*b*, 4*c* are provided at the rear portion of the deck 4. The standing deck 4*a* has a flat floor surface on which the rider stands. The standing deck 4*a* is located rearward relative to the engine room 10. The floor surface of the standing deck 4*a* is set to be lower than the upper end of the engine room 10. The standing deck 4*a* has on the front side thereof, a front wall 4*d* protruding upward and extending in a rightward and leftward direction. The standing deck 4*a* is isolated from the engine room 10 by the front wall 4*d*. The deck fins 4*b*, 4*c* are provided on the right side and the left side of the standing deck 4*a*, respectively, to protrude upward and extend in a forward and rearward direction. The front end portions of the deck fins 4*b*, 4*c* are continuous with the front wall 4*d*. The standing deck 4*a* is surrounded by the deck fins 4*b*, 4*c*, and the front wall 4*d* which have a U-shape when viewed from above.

The front end portion of a handle pole 7 is coupled to the upper surface of the deck 4 in front of the maintenance opening 10*a* in such a manner that handle pole 7 is rotatable around the front end portion. The handle pole 7 is vertically pivotable around the front end portion thereof. A bar-type steering handle 8 is attached on the rear end portion of the handle pole 7. A groove 6*a* extending in the forward and rearward direction is provided in the center portion in the rightward and leftward direction of the upper surface of the engine hood 6. The handle pole 7 is accommodated in the groove 6*a* in a state in which the steering handle 8 is not gripped by the rider. The rider stands on the standing deck 4*a*, grips the steering handle 8, and moves the handle pole 7 upward. In this state, the rider steers the personal watercraft 1.

An engine 11 is placed in the engine room 10. The output shaft of the engine 11 is connected to a propeller shaft 12 extending rearward in the interior of the body 2. A water jet pump (not shown) is driven by the propeller shaft 12. The water jet pump pressurizes and accelerates water suctioned through a suction port provided in the hull 3. The pressurized and accelerated water is ejected rearward through a jet nozzle 13 attached to the rear end portion of the body 2. In this way, a forward propulsive force is generated in the body 2.

An air cleaner 14, a battery 15, and a fuel tank 16 are placed in the engine room 10. The air cleaner 14 is connected to the intake port of the engine 11 through an air-intake pipe 17. The battery 15 is configured to store electric power to be supplied to electric components such as a starter motor (not shown) for starting the engine 11, and a controller (not shown) for controlling the engine 11. The fuel tank 16 is configured to store fuel to be supplied to the combustion chamber of the engine 11. The air cleaner 14 is placed rearward relative to the engine 11 and located in the rear portion of the engine room 10. The battery 15 is placed in front of the engine 11. The fuel tank 16 is placed in front of the engine 11 and the battery 15. The fuel tank 11 is located in the front portion of the engine room 10. Further, a part of an exhaust system 20 (see FIG. 3) of the engine 11 is placed in the engine room 10.

Figure 3:
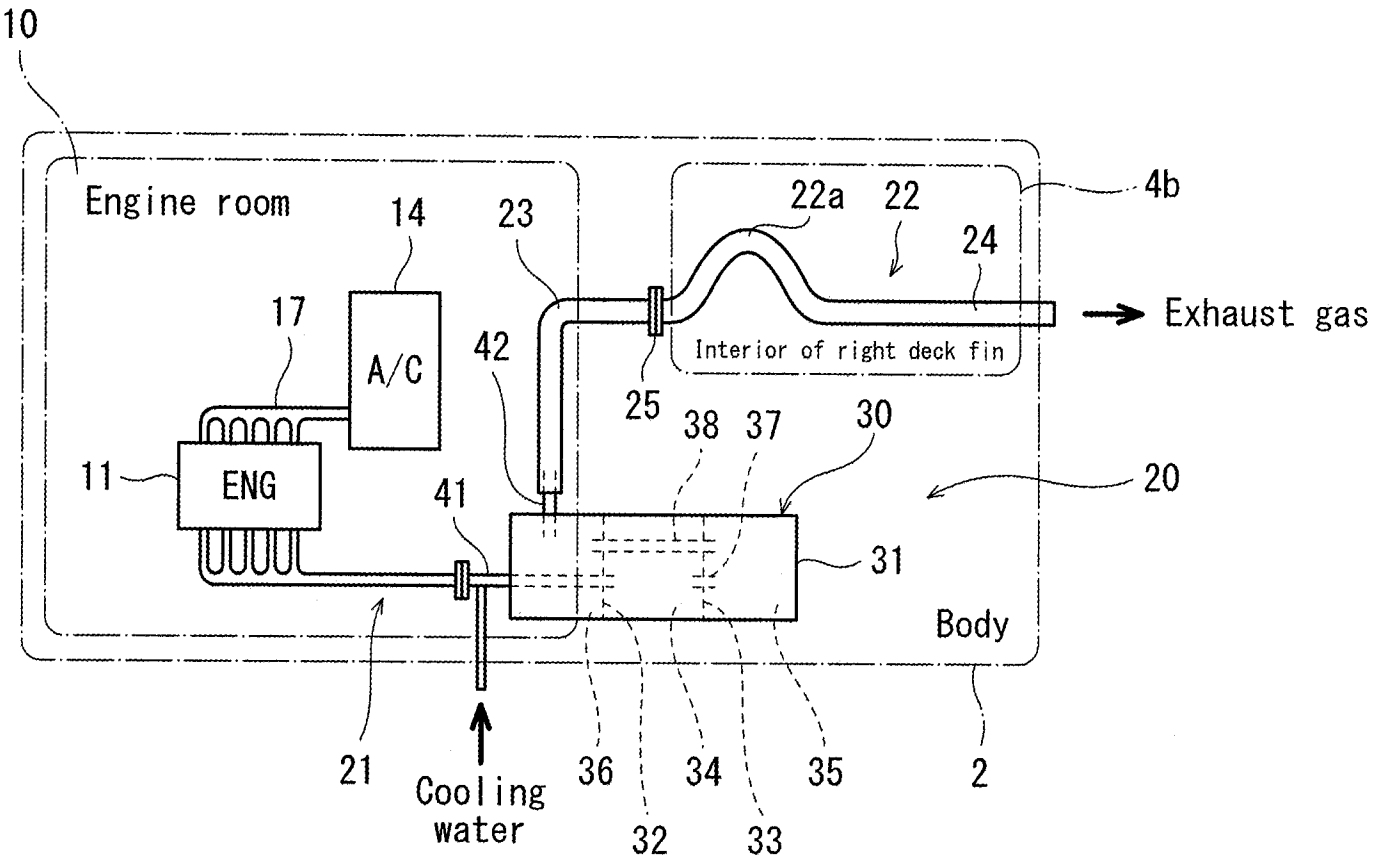
FIG. 3 is a view schematically showing the configuration and layout of an exhaust system.

As shown in FIG. 3, the exhaust system 20 includes a first exhaust pipe 21, a second exhaust pipe 22, and a water muffler 30. The first exhaust pipe 21 includes one pipe member or a plurality of pipe members which are coupled to each other. The second exhaust pipe 22 has a similar structure.

The first exhaust pipe 21 connects the exhaust port of the engine 11 to a water muffler 30 and serves to guide an exhaust gas emitted from the engine 11 to the water muffler 30. The exhaust gas flows through the water muffler 30, and thereby a noise of the exhaust gas is reduced. The second exhaust pipe 22 serves to guide the exhaust gas which has flowed through the water muffler 30, to outside of the watercraft. The upstream end of the second exhaust pipe 22 is connected to the water muffler 30, while the downstream end of the second exhaust pipe 22 is opened at the stern. The exhaust gas emitted from the engine 11 flows through the first exhaust pipe 21, the water muffler 30, and the second exhaust pipe 22 in this order, and is discharged to outside of the watercraft.

The temperatures of the components included in the exhaust system 20 are elevated by exhaust heat radiated from the engine 11. The exhaust system 20 includes a cooling water passage through which cooling water flows, in addition to an exhaust passage through which the exhaust gas flows. The water surrounding the personal watercraft 1 is used as the cooling water. The temperatures of the components included in the exhaust system 20 and the temperature of the exhaust gas can be lowered by cooling using the water.

The structure of the water muffler 30 will now be described. A muffler body 31 of the water muffler 30 has a cylindrical shape. The muffler body 31 includes a first side wall 31*a* located on a first side (one side) in an axial direction, a second side wall 31*b* located on a second side (the other side) in the axial direction, and a peripheral wall 31*c* connecting the side walls 31*a*, 31*b* to each other, and having a circular cross-section. The muffler body 31 has an inner space surrounded by the walls 31*a* to 31*c*. The muffler body 31 includes a first separating wall 32 and a second separating wall 33 which are placed in an inner space thereof to be spaced apart from each other in the axial direction. The inner space of the muffler body 31 is separated into three chambers 34 to 36 arranged in the axial direction, by the separating walls 32, 33. The first chamber 34 is in communication with the second chamber 35 via a first communicating portion 37. The second chamber 35 is in communication with the third chamber 36 via a second communicating portion 38.

The first chamber 34 is placed between the second chamber 35 and the third chamber 36 in the axial direction and surrounded by the two separating walls 32, 33. The first separating wall 32 and the third chamber 36 are placed on the first side in the axial direction. The second separating wall 33 and the second chamber 35 are placed on the second side in the axial direction. The first communicating portion 37 is constituted by a pipe or a through-hole provided on the second separating wall 33. The second communicating portion 38 is constituted by a pipe penetrating the first separating wall 32 and the second separating wall 33 and extending through the interior of the first chamber 34.

The water muffler 30 includes an inlet pipe 41 and an outlet pipe 42. The upstream end portion of the inlet pipe 41 is connected to the downstream end portion of the first exhaust pipe 21. The downstream end portion of the inlet pipe 42 is opened in the first chamber 34. The upstream end portion of the outlet pipe 42 is opened in the third chamber 36. The downstream end portion of the outlet pipe 42 is connected to the upstream end portion of the second exhaust pipe 22. The exhaust gas emitted from the first exhaust pipe 21 flows through the inlet pipe 41, the first chamber 34, the first communicating portion 37, the second chamber 35, the second communicating portion 38, the third chamber 36, and the outlet pipe 42 in this order, and into the second exhaust pipe 22.

The inlet pipe 41 penetrates the first side wall 31*a* and the first separating wall 32 and extends through the interior of the third chamber 36. The inlet pipe 41 protrudes from the first side wall 31*a* in a first direction (one direction) of the axial direction and is connected to the first exhaust pipe 21 in a location that is apart from the muffler body 31 in the first direction of the axial direction. The outlet pipe 42 protrudes radially from the peripheral wall 31*c* and is connected to the second exhaust pipe 22 in a location that is radially apart from the muffler body 31. Since the inlet pipe 41 penetrates the first side wall 31*a* located on the first side in the axial direction and the third chamber 36 is located on the first side in the axial direction, the outlet pipe 42 is close to the inlet pipe 41 in the axial direction. For example, in a case where the water muffler 30 is placed in the interior of the body 2 in such a manner that the axial direction of the water muffler 30 conforms to the forward and rearward direction, the inlet pipe 41 and the outlet pipe 42 are placed in the front portion of the water muffler 30.

The water muffler 30 is placed at the left part of the body 2 with respect to a center line C of the body 2, in the rightward and leftward direction. The first exhaust pipe 21 is placed on the left side of the engine 11 and extends rearward from the engine 11. The water muffler 30 is placed rearward relative to the engine 11. More specifically, the water muffler 30 is placed to overlap with the left deck fin 4*c* when viewed from above (see FIG. 1). The water muffler 30 is placed below the left deck fin 4*c* and accommodated in the interior of the hull 3 (see FIG. 2). The outer diameter of the water muffler 30 is set to be greater than the width of the lower end portion of the deck fin 4*c* in the rightward and leftward direction. This allows the width of the deck fin 4*c* to be smaller than that of the water muffler 30.

The first side wall 31*a* faces the front, while the second side wall 31*b* faces the rear (see FIGS. 2 and 3). The inlet pipe 41 protrudes forward from the first side wall 31*a* (see FIGS. 2 and 3). The downstream end portion of the first exhaust pipe 21 is connected to the inlet pipe 41 from the front (see FIGS. 2 and 3).

The outlet pipe 42 protrudes upward from the first portion (i.e., front portion) of the water muffler 30 in the axial direction (see FIG. 1). The second exhaust pipe 22 includes a transverse pipe member 23 connected to the water muffler 30, and a downstream pipe member 24 connected to the downstream end portion of the transverse pipe member 23 (see FIGS. 1 to 3). The downstream end portion of the transverse pipe member 23 and the upstream end portion of the downstream pipe member 24 are connected to each other by a clamp member 25 as a pipe joint (see FIGS. 1 to 3). The clamp member 25 is attached to the outer peripheral surfaces of the pipe members. For this reason, the second exhaust pipe 22 has a shape in which the diameter of a portion of the second exhaust pipe 22, which is in the vicinity of the clamp member 25 in the lengthwise direction of the second exhaust pipe 22, is greater than that of the remaining portion of the second exhaust pipe 22. The outer diameter of the clamp member 25 is set to be greater than that of the transverse pipe member 23 and that of the downstream pipe member 24.

The transverse pipe member 23 is connected to the downstream end portion of the outlet pipe 42, and extends in the rightward and leftward direction in the interior of the engine room 10 (see FIGS. 1 and 2). More specifically, the transverse pipe member 23 extends in the rightward and leftward direction within a slight clearance in the forward and rearward direction, which is formed between the front wall which isolates the standing deck 4*a* from the engine room 10, and the air cleaner placed rearward relative to the engine in the interior of the engine room 10. The transverse pipe member 23 is made of rubber and has an elasticity. The downstream end portion of the transverse pipe member 23 is connected to the upstream end portion of the downstream pipe member 24 via the clamp member 25. The downstream pipe member 24 extends rearward and is placed in the interior of the right deck fin 4*b*. The inner spaces of the right and left deck fins 4*b*, 4*c* cannot be accessed easily by a user, but are spatially in communication with the engine room 10. Since the exhaust system 20 includes the transverse pipe member 23 which allows the left part and right part of the body 2 to be in communication with each other, it becomes possible to prevent the backflow of the water toward the engine through the exhaust pipe, even if the personal watercraft 1 is inverted to the left or to the right.

The second exhaust pipe 22 includes a swelling portion 22*a* protruding upward. Because of the presence of the swelling portion 22*a*, it becomes possible to prevent a situation in which the water reaches a portion of the second exhaust pipe 22 which is upstream of the swelling portion 22*a* even when the water outside the watercraft flows forward through the downstream end portion of the second exhaust pipe 22 as backflow. In this way, the water muffler 30 and the engine 11 can be protected.

The swelling portion 22*a* is provided at the downstream pipe member 24. The upstream end portion of the downstream pipe member 24 and the clamp member 25 are placed below the top portion of the swelling portion 22*a* (see FIG. 1). The upstream portion of the second exhaust pipe 22 has an inverted-U shape.

The swelling portion 22*a* is accommodated in the interior of the right deck fin 4*b*. The upstream end portion of the downstream pipe member 24 is placed forward relative to the top portion of the swelling portion 22*a*. The upstream end portion of the downstream pipe member 24 and the clamp member 25 are placed at the front end portion of the right deck fin 4*b* or slightly in front of the front end portion of the right deck fin 4*b*. The top portion of the swelling portion 22*a* is formed by only the downstream pipe member 24.

Figure 4A:
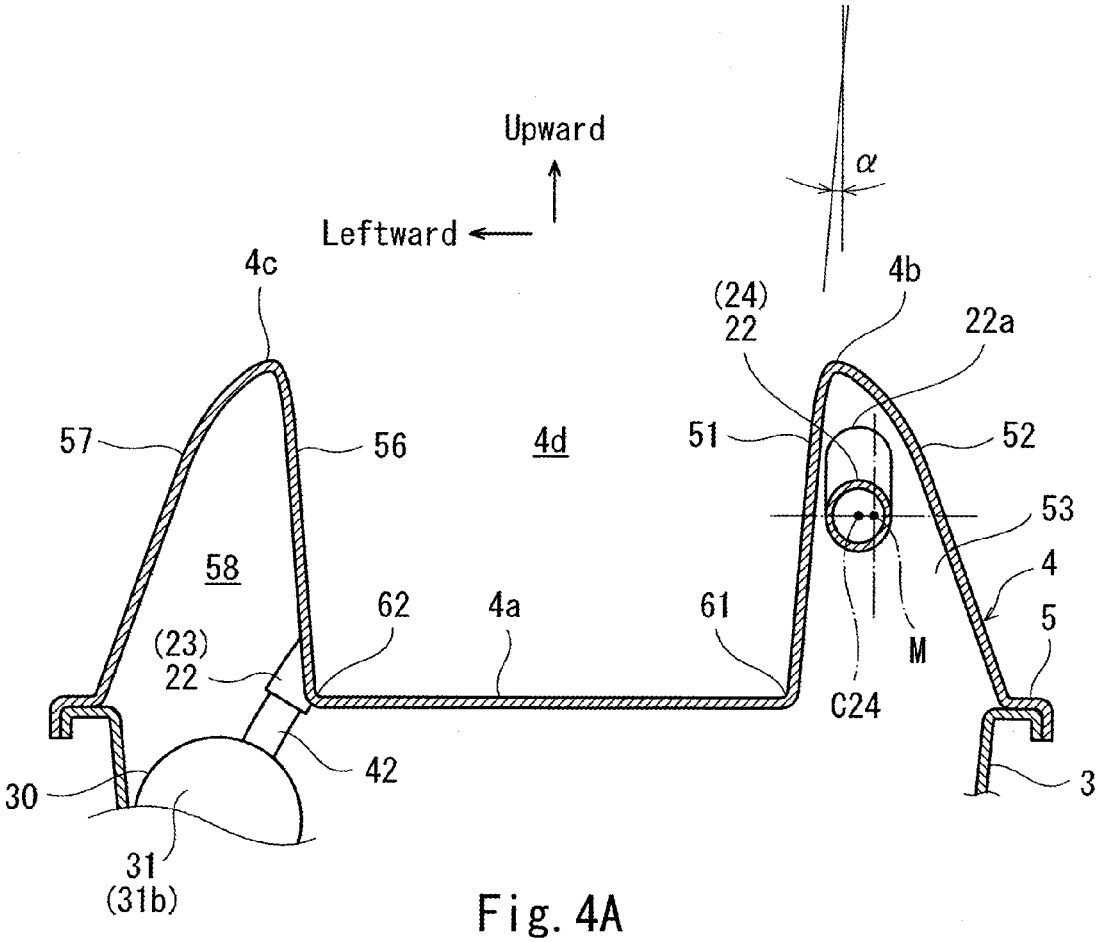
FIG. 4A is a cross-sectional view taken along A-A of FIG. 2.
Figure 4B:
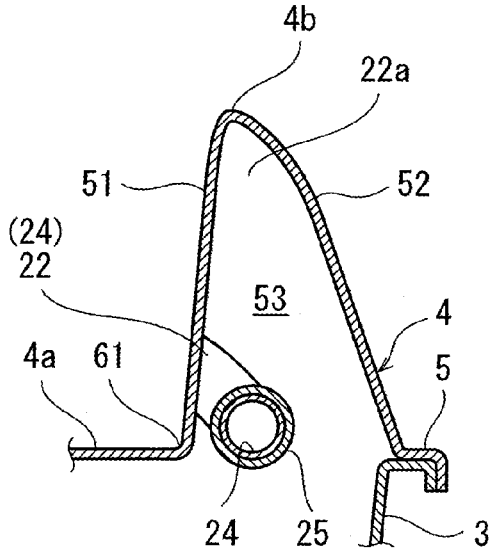
FIG. 4B is a cross-sectional view taken along B-B of FIG. 2.

FIG. 4A is a cross-sectional view of the right deck fin 4*b*, in a region which is in the vicinity of the clamp member 25, when viewed from the rear. FIG. 4B is a cross-sectional view of the right deck fin 4*b*, in a region which is in the vicinity of the top portion of the swelling portion 22*a*, when viewed from the rear. As shown in FIG. 4A, the top portion of the swelling portion 22*a* is close to the inner surface of the top portion of the right deck fin 4*b*. In contrast, as shown in FIG. 4B, the upstream end portion of the downstream pipe member 24 is vertically apart from the inner surface of the top portion of the right deck fin 4*b*. The width of the right deck fin 4*b*, in the rightward and leftward direction is reduced, as the right deck fin 4*b* extends upward. In a case where the deck 4 having the above-described configuration is manufactured by molding, the deck fin 4 can be designed in such a manner that portions which are in the vicinity of the deck fins 4*b*, 4*c* are molded by making a draft direction conform to a direction in which the deck fins 4*b*, 4*c* protrude. In that case, the right side surface and left side surface of the deck fin are formed with draft angles, respectively, and thus the width of the right deck fin 4*b* is designed in the above-described manner.

If the transverse pipe member 23 and the downstream pipe member 24 are connected to each other in the top portion of the swelling portion 22*a*, the top portion of the right deck fin 4*b* is required to have a great lateral width so that the clamp member 25 can be accommodated therein. In a case where the deck fin 4*b* is molded by making the draft direction conform to the direction in which the deck fin 4*b* protrudes, the lower portion of the right deck fin 4*b* is expanded. This may lead to reduction of the width of the standing deck 4*a*. In the present embodiment, the clamp member 25 is placed in the lower portion of the right deck fin 4*b*. This makes it possible to reduce the width of the right deck fin 4*b*, and increase the width of the standing deck 4*a*. As a result, the stand-up type personal watercraft 1 which can be steered easily by the rider can be realized.

The water muffler 30 is placed rearward relative to the engine 11 (see FIG. 1). The inlet pipe 41 is provided on the first side wall 31*a* (front wall) of the muffler body 31 so that the inlet pipe 41 can be linearly connected to the first exhaust pipe 21. On the front side of the muffler body 31, the third chamber 36 which is a furthest downstream chamber, of the chambers 34 to 36, is placed (see FIG. 3). Thus, the outlet pipe 42 is also placed at the front portion of the water muffler 30. Since the outlet pipe 42 is placed at the front portion of the water muffler 30, the upstream portion of the second exhaust pipe 22 is made close to the engine 11. In this layout, the water muffler 30 can be placed below the left deck fin 4*c*, and the upstream portion of the second exhaust pipe 22 can be placed in front of the standing deck 4*a*. Also, the upstream portion of the second exhaust pipe 22 can be placed in the engine room 10. In the rear end portion of the engine room 10, a gap is formed between the separating wall and the air cleaner 14. The transverse pipe member 23 can be extended through this gap. In this way, the transverse pipe member 23 can be placed while avoiding interference with the propeller shaft 12. The transverse pipe member 23 is made of rubber, and is bendable. Therefore, the transverse pipe member 23 can be easily placed in a narrow space. In addition, an operation for connecting the water muffler 30 and the downstream pipe member 24 to each other can be performed easily by use of the transverse pipe member 23.

In accordance with the exhaust system 20 having the above-described configuration, the water muffler 30 is placed below the left deck fin 4*c* and accommodated in the hull 3. The first exhaust pipe 21 extends rearward from the engine 11 on the left side of the engine 11, and is connected to the water muffler 30. A portion of the second exhaust pipe 22 extends in the forward and rearward direction, in the interior of the right deck fin 4*b*.

In the above-described manner, the water muffler 30 is placed efficiently in the space formed below the deck fin 4*b*, 4*c*. Because of this layout, it is not necessary to design the deck fin 4*b*, 4*c* so that the deck fin 4*b*, 4*c* can have a great width to accommodate the water muffler 30 therein. Since the width of the deck fins 4*b*, 4*c* can be reduced, the width of the standing deck 4*a* can be increased.

The deck fins 4*b*, 4*c*, and the standing deck 4*a* are placed rearward relative to the engine 11. The water muffler 30 is placed below the deck fin 4*c*, and the second exhaust pipe is accommodated in the deck fin 4*b*. The water muffler 30 and the second exhaust pipe 22 are placed rearward relative to the engine 11. In this layout, members extending from the exhaust system and laid out in front of the engine can be omitted. The downstream end portion of the whole exhaust system is placed at the stern. This can shorten the path length of the pipes included in the exhaust system. Thus, the structure of the exhaust system 20 can be simplified. As a result, an operation for connecting the pipe members or an operation for mounting the exhaust system in the body can be easily performed.

The first exhaust pipe 21 is connected to the front portion of the water muffler 30. This can make the path length of the first exhaust pipe 21 as short as possible. The second exhaust pipe 22 includes the transverse pipe member 23 (transverse section) which extends from the water muffler 30, transversely from the left to the right, through the interior of the body 2. The transverse pipe member 23 is placed rearward relative to the engine 11 and in front of the standing deck 4*a*. Since the transverse pipe member 23 is placed rearward relative to the engine 11 in the above-described manner, the path length of the second exhaust pipe can be made as short as possible. Since the transverse pipe member 23 is placed in front of the standing deck 4*a*, the exhaust pipe does not interfere with a space in which the rider's feet are located.

The upper end portion of the transverse pipe member 23 is connected to the front portion of the water muffler 30. This makes it possible to place the transverse pipe member 23 in a location which is as far forward as possible. Therefore, it becomes possible to increase the size of the standing deck 4*a* in the forward and rearward direction, and efficiently place the water muffler 30 in the space formed below the deck fin 4*c*. In this layout, the front portion of the water muffler 30 is placed to overlap with the rear portion of the engine room 10, when viewed from above (see FIG. 3). As a result, it becomes possible to reduce the width of the deck fins in the rightward and leftward direction in a state in which the water muffler 30 is accommodated in the interior of the hull 3, and to lay out the transverse pipe member with a short path length in the interior of the engine room.

Regarding the right deck fin 4*b*, the top portion of the swelling portion 22*a* is accommodated in the interior of the deck fin 4*b*, and the clamp member 25 connecting the transverse pipe member 23 to the downstream pipe member 24 is placed below and in front of the swelling portion 22*a*. The water muffler 30 is not accommodated in the interior of the right deck fin 4*b*. This makes it possible to prevent a situation in which the width of the right deck fin 4*b* is increased due to the presence of the water muffler 30 and the clamp member 25. As a result, the width of the standing deck 4*a* can be increased.

Since the width of the standing deck 4*a* can be increased in the above-described manner, the rider can perform a quick turn operation. Specifically, the rider can turn the body 2 with a small turn radius while maintaining a high speed. In a case where the rider turns the body 2 to the right, the rider moves a right foot to the front, opens the right foot to the right, engages the right foot with the front portion of the right edge 61 of the standing deck 4*a*, and leans a right leg against an inner side wall 51 of the right deck fin. If necessary, the rider lowers an upper half body to the right, and transfers a body weight to the deck fin 4*b* through the right leg. Thereby, a roll moment directed to a lower right side is applied to the body 2, and the body 2 is banked to the lower right side. In this way, the personal watercraft 1 can turn with a small turn radius even at a high speed.

Since the width of the standing deck 4*a* in the rightward and leftward direction is increased, a range in which the foot located on the front side is movable can be increased, and hence the foot located on the front side and the foot located on the rear side can be easily reversed. Further, since the location to which the body weight is applied is distant from the center line C in the rightward and leftward direction, the roll moment can be increased easily.

The right deck fin 4*b* includes the inner side wall 51 extending upward from the right edge 61 of the standing deck 4*a* on an inner side in the rightward and leftward direction, and an outer side wall 52 protruding upward from the gunnel line 5 on an outer side in the rightward and leftward direction. The upper end portion of the inner side wall 51 is continuous with the upper end portion of the outer side wall 52. The inclination angle (corresponding to a draft angle $\alpha$) of the inner side wall with respect to a vertical direction is smaller than that of the outer side wall. In other words, the inner side wall 51 protrudes upward from the right edge 61 of the standing deck 4*a* in such a manner that the inner side wall 51 is steeper than the outer side wall 52 is. This reduces a distance in the rightward and leftward direction, from the top point of the deck fin 4*b* to the right edge of the standing deck 4*a*. The left deck fin 4*c* has the same structure. The left deck fin 4*c* has an inner side wall 56 and an outer side wall 57. The inner side wall 56 protrudes upward steeply from the left edge 62 of the standing deck 4*a*. In this configuration, the width of the standing deck 4*a* can be increased.

The exhaust pipe (the second exhaust pipe 22, in particular, the downstream pipe member 24 of the second exhaust pipe 22) is accommodated in an inner space 53 of the right deck fin 4*b*. The exhaust pipe (downstream pipe member 24) is made closer to the inner surface of the inner side wall 21 rather than the inner surface of the outer side wall 22. In other words, the center C24 of the exhaust pipe is made closer to the inner side wall 51 than a middle point M is, the middle point M being of a line segment extending through the center C24 and connecting the inner surface of the inner side wall 51 to the inner surface of the outer side wall 52. Since the inner side wall extends upward steeply, the exhaust pipe can be placed to be closer to the inner side wall 51.

The above-described configuration and illustration are merely exemplary, and can be changed within the scope of the invention. For example, the water muffler may also be placed in the right deck fin, and thus two water mufflers may be included in the exhaust system. In this case, also, preferably, the water mufflers are placed below the deck fins, respectively, and accommodated in the hull, to reduce the width of the deck fins and to increase the width of the standing deck. Further, although the water muffler 30 is located below the left deck fin and the downstream pipe member of the second exhaust pipe is accommodated in the right deck fin, the water muffler 30 may be placed below the right deck fin and the downstream pipe member of the second exhaust pipe may be accommodated in the left deck fin.

The invention claimed is:

1. A stand-up type personal watercraft comprising:

a body including a deck and a hull, and containing an engine room formed therein;

an engine accommodated in the engine room;

a standing deck which is provided at the deck, located rearward relative to the engine room, and on which a rider stands;

a pair of deck fins located on a left side and a right side of the standing deck, respectively, and protruding upward;

a muffler through which an exhaust gas emitted from the engine flows, and which reduces a noise of the exhaust gas flowing through the muffler;

a first exhaust pipe which guides the exhaust gas emitted from the engine to the muffler; and a second exhaust pipe which guides the exhaust gas which has flowed through the muffler, to outside of the personal watercraft, wherein the muffler is placed below the deck fin located on a first side which is one of the left side and the right side, and accommodated in the hull, wherein the first exhaust pipe extends rearward on the first side from the engine and is connected to the muffler, and wherein a portion of the second exhaust pipe extends in a forward and rearward direction in an interior of the deck fin located on a second side which is the other of the right side and the left side.

2. The stand-up type personal watercraft according to claim 1, wherein the first exhaust pipe is connected to a front portion of the muffler.

3. The stand-up type personal watercraft according to claim 1, wherein the second exhaust pipe includes a transverse section which extends from the muffler, transversely through an interior of the body from the first side to the second side, and the transverse section is placed rearward relative to the engine and in front of the standing deck.

4. The stand-up type personal watercraft according to claim 3, wherein an upstream end portion of the transverse section is connected to a front portion of the muffler.

* * * * *